US006682311B2

(12) United States Patent
Chung et al.

(10) Patent No.: US 6,682,311 B2
(45) Date of Patent: Jan. 27, 2004

(54) PNEUMATIC DRIVING DEVICE FOR MICRO FLUIDS WHEREIN FLUID PUMPING IS GOVERNED BY THE CONTROL OF THE FLOW AND DIRECTION OF INCIDENT PLURAL GAS STREAMS

(75) Inventors: Yung-Chiang Chung, Hsinchu (TW); Te-Chun Wu, Pingtung (TW); Yuan-Fong Kuo, Hsinchu (TW); Shr-Hau Huang, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 16 days.

(21) Appl. No.: 10/156,054

(22) Filed: May 29, 2002

(65) Prior Publication Data

US 2003/0223880 A1 Dec. 4, 2003

(51) Int. Cl.[7] ..... F04F 5/44
(52) U.S. Cl. ..... 417/151; 417/163; 417/165
(58) Field of Search ..... 417/151, 163, 417/165, 170, 174, 180, 187

(56) References Cited

U.S. PATENT DOCUMENTS 642,545 A * 1/1900 Chapman ..... 417/163
1,026,399 A * 5/1912 Koerting ..... 417/174
2,125,913 A * 8/1938 Goebels ..... 366/137
3,045,897 A * 7/1962 Wood ..... 417/54
3,129,874 A * 4/1964 Mittelstaedt ..... 417/151
3,135,221 A * 6/1964 Mittelstaedt ..... 417/151
3,139,838 A * 7/1964 Mittelstaedt ..... 417/176
4,310,288 A * 1/1982 Erickson ..... 417/54
5,529,465 A 6/1996 Zengerle et al.
5,599,175 A 2/1997 Tojo et al.
5,632,876 A 5/1997 Zanzucchi et al.
5,705,018 A 1/1998 Hartley
5,788,468 A 8/1998 Dewa et al.
6,364,626 B1 * 4/2002 Popov ..... 417/196

* cited by examiner

*Primary Examiner*—Justine R. Yu
*Assistant Examiner*—Emmanuel Sayoc
(74) *Attorney, Agent, or Firm*—Birch, Stewart, Kolasch & Birch, LLP

(57) ABSTRACT

A pneumatic driving device and the associated method for micro fluids, wherein the pneumatic driving device for micro fluids is constructed by connecting a fluid pipe with a structure that is formed by two gas stream inlets, a gas stream fender, a gas stream flow path and a gas stream outlet. The suction, exclusion and stagnation for the micro fluids inside the fluid pipes can be accomplished by adjusting the flow rates of the gas streams into the device at the two gas stream inlets. In the invention several pneumatic driving devices are connected to form a single recursive pneumatic driving device by the concept of recursion, and the micro fluids inside several fluid pipes can be controlled to mix or to separate through the recursive pneumatic driving device by adjusting the flow rates of the gas streams into the device at different gas stream inlets.

13 Claims, 8 Drawing Sheets

PNEUMATIC DRIVING DEVICE FOR MICRO FLUIDS WHEREIN FLUID PUMPING IS GOVERNED BY THE CONTROL OF THE FLOW AND DIRECTION OF INCIDENT PLURAL GAS STREAMS

BACKGROUND OF THE INVENTION

1. Field of Invention

The invention relates to a driving device for micro fluids and especially relates to a pneumatic driving device and the associated method for micro fluids. By the concept of recursion, a recursive pneumatic driving device and its associated method for micro fluids can be established.

2. Related Art

Because of the recent development of biochips the related technologies in the field are becoming more important ever than before, and the micro-scale total analysis system ($\mu$ TAS) for biochips has become the necessary key point to the design and analysis of biochips. Hence, the associated so-called micro fluid systems for biochips have become a serious research subject and are being studied extensively. The micro fluid systems let the biochips completely function and can allow the bio-chemical substances inside the biochips mix and react with the examined species entering into the biochips completely. They comprise many micro fluid elements such as micro pumps, micro valves, micro fluid pipes and micro fluid mixers. In order to integrate these micro fluid elements to become a complete micro-scale total analysis system, new and innovative structures and manufacturing processes for biochips should be further studied.

Usually the micro fluid system has to separate the incoming micro fluids into several parts, and in the mean time micro valves are conventionally utilized to separate the incoming micro fluids and to guide them into one of the following branch pipes. Micro valves are active parts and have two disadvantages when they are in use, that is, they are more expensive and their performance is not so stable. Therefore, much research has been proposed to attempt to use passive parts in constructing micro valves to overcome these disadvantages. Related research results about the micro fluid systems in the past, for example the studies of micro pumps and micro fluid switchers, are described as follows:

1. On-chip built-in mechanical micro pump: this kind of micro pump can be directly built on biochips by micromachining technology and with this design some movable parts should be set inside the biochips. Some proposed designs based on this concept are described as follows:

First is the electrostatically driven diaphragm micro pump invented by Roland Zengerle etc., (U.S. Pat. No. 5,529,465), wherein the main body of the micro pump comprises four layers of silicon substrate. Pumping action can be accomplished by the pulsating electrostatic attraction among the upper two silicon layers induced by supplying the specific AC current (50V, 400 Hz) together with two passive check valves. The performed flow rate is about 350 $\mu$l/min.

The micro machined peristaltic pump invented by Frank T. Hartley (U.S. Pat. No. 5,705,018) is a more succinct design. With this design serial flexible conductive strips are placed on the inner walls of the micro pipes of the biochips and when the electric potential pulse waves go through above the micro pipes, the serial flexible conductive strips are attracted by the electrostatic forces to move upward in sequence to form the peristaltic phenomenon of the micro pipes. Accordingly this peristaltic phenomenon can be utilized to drive the micro fluids to flow inside the micro pipes. The phase of the applied electric potential pulse waves must be carefully controlled and the peak value is about 100 V. The performed flow rate is 100 $\mu$l/min.

The disadvantages of the above described on-chip built-in mechanical micro pumps are that the structures are too complicated, it is not easy to clean the micro pumps, and the manufacturing and assembling processes are difficult. These built-in mechanical micro pumps cannot be used repeatedly when they are applied to test the chemical reagents because it is very difficult to completely clean them. So, a biochip is used only one time and then discarded, but this greatly increases production cost. Unfortunately for the on-chip built-in mechanical micro pumps and the on-chip built-in peristaltic pump complicated manufacturing processes and/or costly specific materials must be utilized. Thus the production cost will be greatly increased, and of course, this result is contrary to the requirements of mass production.

In 1998 Andrews S. Dewa and Christophe J. P. Servrain proposed the design concept of remote actuators for micro fabricated fluidic devices (U.S. Pat. No. 5,788,468), wherein the active movable parts (actuators) of micro pumps are replaced on the outside surrounding regions of the biochips. Inside the biochips are placed only the on-chip movable members that are formed by LIGA technology and are similar to pistons or turbines. The actuators placed outside the biochips can drive the on-chip passive movable parts settled inside the biochips to reciprocate or to rotate in specific pump chambers to accomplish the pumping action. The focus of this proposed patent is that different precious on-chip movable parts can be easily established by LIGA technology and can be applied easily together with the associated unsophisticated chambers to achieve the pumping action for micro fluids. Hence this invention has partially overcome the problem of the high production cost of one-time-use biochips. However, the question of how power can be transmitted from the outside actuators to the on-chip movable parts was not answered.

If the outside actuators are connected with the on-chip movable parts by levers, then the movable parts cannot be completely sealed inside the pumping chambers. It is reasonable that the required engineering specifications for the production of biochips must be enhanced so that the micro fluids cannot leak out of the pumping chambers under the reciprocation of the movable parts and under the high pressure inside the pumping chambers. It was suggested in the above-described patent to utilize the magnetic rotor device to drive the movable parts sealed completely inside the pumping chambers to accomplish the pumping action by the electromagnetic effects. This suggestion was also proposed by Kaluji Tojo and Yoshiaki Hirai in 1997 for their invention "micro flow controlling pump" (U.S. Pat. No. 5,599,175). However, specific and expensive materials must be utilized to construct the magnetic pulp bodies as the movable parts.

2. On-chip built-in electrode micro pump: this kind of micro pump is not a mechanical micro pump and with this design it is not necessary to set movable parts inside the micro pump. Conventional operating principles for this kind of micro pump are classified in three different types (electroosmosis EO, electrohydrodynamics EHD and electrophorosis EP) and will be described as follows:

The invention "apparatus and methods for controlling fluid flow in micro channels" (U.S. Pat. No. 5,632,876) proposed by Peter J. Zanzucci etc. in 1997 is a combinative application of electroosmosis and electrohydrodynamics, wherein four electrodes classed among two pairs are interlaced inside the micro pipes of biochips. The inner pair of electrodes is set close to each other and both stretch into the micro fluids inside the micro pipes. The current circuit can be formed by this pair of electrodes and the surrounding micro fluids around this pair of electrodes when a high voltage is supplied. At the same time the surrounding micro fluids around this pair of electrodes is pushed to move along the direction against the current direction. This phenomenon is the so-called Electrohydrodynamic pumping (EHD Pumping). The other outside pair of electrodes is placed a little farther away from each other and only touch the pipe walls of the micro pipes. When hundreds to thousands of high voltages are supplied to the outside pair of electrodes, the pipe walls of the micro pipes are firstly electrically charged, then negative and positive electric charges gather on the material surfaces where the positive and negative electrodes are, respectively, and consequently when the micro fluids contain negative electric particles, these particles are attracted toward the direction to the negative electrode, which is filled with positive electric charges. The micro fluids are also attracted toward to the positive electrode, which is filled with negative electric charges. The above-described phenomenon is the so-called Electroosmosis pumping (EO pumping). The focus of this proposed invention is to combine and integrate these two different pumping phenomena with different pumping directions to accomplish the pumping actions for micro fluids and the guiding controls for micro fluids like propelling action, expelling action and stagnate action. The working micro fluids for electroosmosis must be polar solutions containing electrically charged particles, while for electrohydrodynamics they must be non-polar solutions or organic solutions. This invention claims that after the integration of these two different phenomena the methods proposed can be applied for all micro fluids whether they are polar or non-polar.

In 1997 Paul C. H. Li and D. Jed Harrison proposed another method under their thesis: transport, manipulation and reaction of biological cells on-chip using electrokinetic effects (Anal. Chem. 69,154–158), which is a combined application of electroosmosis and electrophorosis. The working principle of electrophorosis is rather simple and is described as follows: the electrical charged particles of solutions are directly attracted by electrodes and their direction of motion is against that induced by electroosmosis. However, the focus of this invention is that the electrical charged particles of solutions are attracted by both the electroosmosis and the electrophorosisto effects but the solutions are not. Therefore the principle contribution of this invention is to drive the canine erythrocytes existing inside the solutions but not the micro fluids. From the experiments it shows that the canine erythrocytes can easily be guided. Their direction of motion can be changed by the attractive force differences of the electroosmosis and the electrophorosis effects occurring among the interlaced micro pipes.

The disadvantage of the above described on-chip built-in electrode micro pumps is that there are too many restrictions for the application when in use. But from the manufacturing perspective it can be seen that the structure of the electrode micro pumps is the simplest and the production cost is lowest. However, as discussed before, there are too many restrictions for the application when in use:

The micro pipes must be filled with solutions in advance and hence it is not possible to fill examined species or reactive reagents into the empty micro pipes at first.

The EHD pump can only drive the micro fluids to move for a short time while the EO and EP pumps are mainly utilized to drive electrically charged particles of micro fluids and have no influence on the movements of micro fluids. Consequently, the pumping effect induced by the above-mentioned three micro pumps is not significant for micro fluids, and the performed flow rates are about 10 $\mu$l/min. Furthermore, the driving forces of these three different micro pumps can function only in very narrow micro pipes (the diameter of the micro pipes is about 100 $\mu$m) and very high voltages (hundreds to thousands of volts) must be supplied across a very short distance. Therefore, the operating cost is high.

The EHD pumps can only be applied for non-polar organic solutions while the EO and EP pumps are only adequate for polar solutions containing charged ions. The ion concentration of solutions will seriously affect the pumping efficiency of these kinds of micro pumps. Thus it is difficult to guide and control the motions of micro fluids when the incoming examined species and reactive reagents have complex compositions or the ion concentration changes in the reacting processes.

3. On-chip external servo system: this concept is the simplest way to overcome the above-mentioned problems and obviously there is no need to set active parts inside the biochips. Thus the structure of this kind of system is rather unsophisticated and the production cost is also rather low. It is also not necessary to use the micromachining technologies to construct the external servo systems and the external servo systems can be utilized repeatedly because they are not in direct contact with the examined species and reactive reagents. Thus it may be proper to utilize this kind of system to examine the reactions of biochemical substances and reagents for one-time-use biochips. However, with this design perspective another problem of the world-to-chip interface will occur, that is, the connection between the transmission pipes under ordinary scale (transmitted micro fluids may be gases or reagents) and the biochips under micro scale can only be achieved by a number of complicated micromachining technologies.

In 1998 N. J. Mourlas et al. proposed their thesis "novel interconnection and channel technologies for micro fluids, Proceedings of the $\mu$ TAS'98 Workshop, 1998, 27–30", in which different interconnections between transmission pipes and biochips were shown. From the design perspective of this thesis it can be clearly seen that the pressure inside the micro pipes increases rapidly when micro fluids are poured into the micro pipes or into the micro reactive chambers of biochips. Accordingly strict requirements for the connections between the transmission pipes and the biochips should be satisfied (leakage test: 60 psi, pull test: 2N). Conventional epoxy substances should be applied to enhance the connections between the transmission pipes and the biochips. From the above-described design perspective the orientation and location points of the transmission pipes should be firstly defined by DRIE technology and then the polyoxymethylene plastics are applied to form the couplers of the transmission pipes by injection modeling. Although the transmission pipes can just be inserted into biochips by the couplers, it is recommended to reheat the transmission pipes to 250° C. in order to establish more reliable connections.

For the biochips applied to examine biochemical reactions the structures and the manufacturing processes of the on-chip built-in mechanical micro pumps are too sophisticated and their production cost is too high. For the on-chip built-in electrode micro pumps there are too many restrictions for application and their pumping efficiency is not significant. If the problem of the world-to-chip interface can be overcome with the on-chip external servo system then this would be the best way to utilize the servo systems used repeatedly as the guiding elements for micro fluids together with the biochips that are only used one time and have no active parts.

4. Pneumatic micro pump having no junctions: Dr. Yuo proposed this design, which uses simple pneumatic servo systems providing different driving gas streams with different modes. Guiding motion, expelling motion and stagnation motion of micro fluids inside the micro pipes in the internal regions of the micro reactive module can be accomplished when the driving gas stream with a specific mode flows through the airway of the micro reactive module.
5. Pressure difference driven pneumatic micro switch for micro fluids: this was proposed by Brody in 1998 and has three or more reservoirs containing pressured gas. The pressure in the junction of the reservoirs is regulated to equal that of the third pipe. The micro fluids are controlled to flow from the first channel to the second channel. The disadvantage of this design is that it is inconvenient to utilize this micro switch because all reservoirs must be connected to the air supplies independently. Pollution easily occurs if there are no fixed outward blowing gas streams when the biochips are in use.

SUMMARY OF THE INVENTION

In consideration of the above-mentioned problems the principal aim of the invention is to provide a pneumatic driving device and the associated method for micro fluids by controlling the gas flow velocities to control the flow directions of micro fluids.

A second aim of the invention is to provide a pneumatic driving device and the associated method for micro fluids that are constructed by the external servo system together with the one-time-use biochip having no active parts. A gas stream power transmission method is used to drive the micro fluids of the biochip, such that there is no need to form any connection between the external servo system and the biochip. Hence the complicated problem of the world-to-chip does not occur.

In order to achieve these objects the invention provides a pneumatic driving device and the associated method for micro fluids, which includes a pair of gas streams, an gas stream flow path structure and an gas stream flow path. The pair of the gas streams have a controllable flow rate and injection flow direction. The gas stream flow path structure formed by two gas stream inlets, a solitary gas stream fender, a gas stream flow path, a gas stream outlet, and a fluid pipe. The pair of gas streams enters the driving device at the two gas stream inlets, goes through the gas stream fender and the gas stream flow path, and flows out of the driving device at the gas stream outlet. The fluid pipe is connected with the gas stream flow path structure and the suction, the exclusion and the stagnation of one of the micro fluids inside the fluid pipe can be accomplished by adjusting the injection flow rates into the gas stream flow path structure of the pair of gas streams.

The connection between the fluid pipe and the gas stream flow path structure is formed as an outfall in the shape of an inverted triangular, a connective gas stream flow path having a big open mouth or a connective fluid pipe having a small open mouth. The form of the gas stream fender may be an arbitrary combination of a triangle, a square, a circle and a polygon. The position of the gas stream fender may be on the upper region of the outfall or near the outfall. The other end of the fluid pipe is the injection inlet for micro fluids.

The invention provides a recursive pneumatic driving device and the associated method for micro fluids. The recursive pneumatic driving device is constructed by the recursive combination of the above-mentioned inventive pneumatic driving devices. Therefore, the micro fluids inside several micro fluid pipes can be driven and controlled to separate, to mix or to change flow directions.

Further detailed technical embodiments of the invention are described together with the drawings as follows.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The invention proposes a guiding device with no valves for micro fluids, which directly apples the different velocities in the different layers of the gas streams determined by the Navier-Stokes equation of fluid mechanics together with a simple structure design to create different viscous forces to exert on the micro fluids. The guiding action and the exclusion for micro fluids can be accomplished by these different viscous forces. By applying this proposed guiding device with no valves together with the recursive structure the flow directions of micro fluids inside several micro pipes can be controlled.

Figure 1:
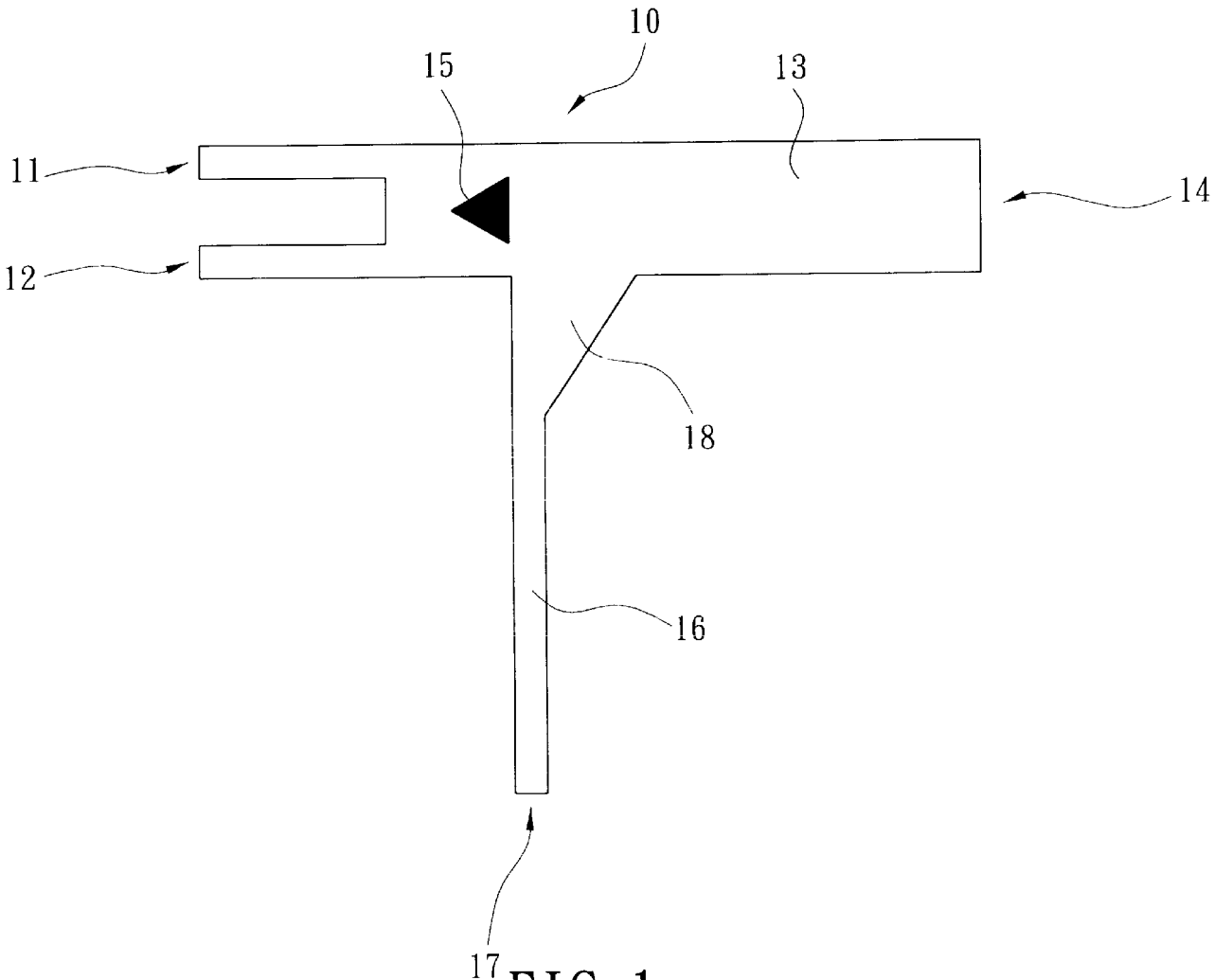
FIG. 1 is a schematic drawing of the pneumatic driving device for micro fluids of the invention.

FIG. 1 shows a first embodiment of the pneumatic driving device for micro fluids of the invention 10. The device comprises the first gas stream inlet 11, the second gas stream inlet 12, the gas stream flow path 13, the gas stream outlet 14, the gas stream fender 15, the micro pipe 16 and the injection inlet for reagents 17. The operating principles of the device are described as follows:

As shown in FIG. 1, because of the gas stream fender 15 the suction force exerted on the micro fluids inside the micro pipe 16 can be accomplished when the gas stream enters the device at the first gas stream inlet 11, goes through the gas stream flow path 13, and flows out of the device at the gas stream outlet 14. The intensity of this suction force depends on the velocity of the gas stream. When the gas stream enters the device at the second gas stream inlet 12, goes through the gas stream flow path 13, and flows out of the device at the gas stream outlet 14, the exclusion force exerted on the micro fluids inside the micro pipe 16 can be accomplished by the gas stream fender 15. The intensity of this exclusion force is also dependent on the velocity of the gas stream. Consequently, the flow direction (down to up or up to down) and the flow velocity (a velocity limit is associated) of the micro fluids inside the micro pipe 16 can be controlled by controlling the velocities of the gas streams entering at the first and second gas stream inlets. Computer programs can be applied to simulate the magnitudes and effects of the suction and exclusion forces, that is, the velocities of the micro fluids.

The whole operating procedures are described as follows: firstly the liquid examined species are injected via the reagents into the device at the injection inlet 17 and then the liquid examined species fill the micro pipe 16. Secondly the flow directions and the velocities of the examined species inside the micro pipe 16 can be controlled by controlling the velocities of the gas streams at the first gas stream inlet 11 and the second gas stream inlet 12 such that the required fluid power can be provided to operate the biochips passively.

Figure 2:
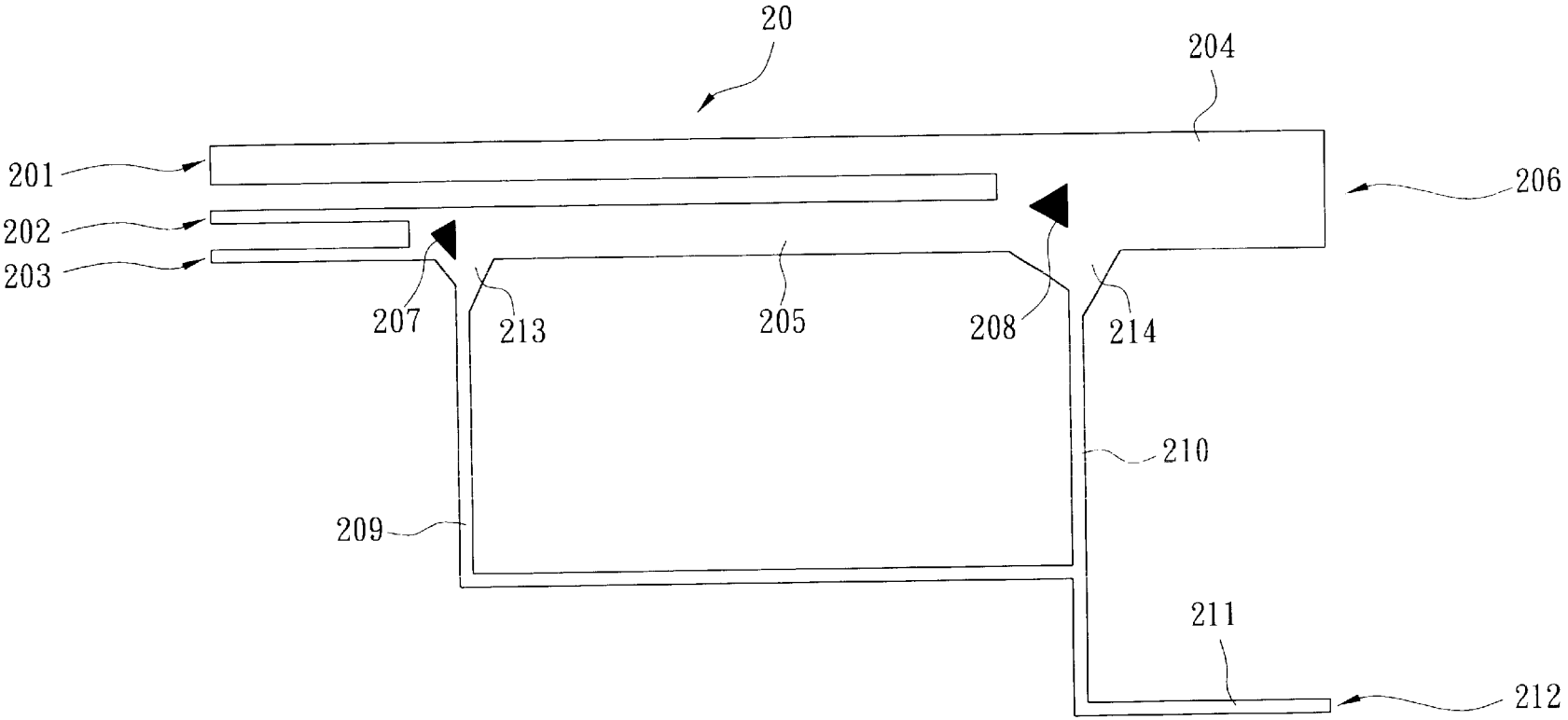
FIG. 2 is a schematic drawing of the recursive pneumatic driving device for micro fluids of the invention.

By extending the above-addressed operating principles and the concept of recursion a recursive pneumatic driving device for micro fluids (as shown in FIG. 2) can be established. By this proposed recursive pneumatic driving device for micro fluids not only can the flow directions of the micro fluids be controlled and guided into two different directions, but also the micro fluids can be controlled to separate and the shunt ratio can be controlled. Two pneumatic driving devices shown in FIG. 1 are utilized to form the embodiment of the recursive pneumatic driving device 20 shown in FIG. 2, which comprises the first gas stream inlet 201, the second gas stream inlet 202, the third gas stream inlet 203, the first gas stream flow path 204, the second gas stream flow path 205, the gas stream outlet 206, the first gas stream fender 207, the second gas stream fender 208, the first micro pipe 209, the second micro pipe 210, the third micro pipe 211 and the injection inlet for reagents 212.

As shown in FIG. 2, the first pneumatic driving device for micro fluids is constructed by the second gas stream inlet 202 and the third gas stream inlet 203 while the second pneumatic driving device for micro fluids is constructed by the first gas stream inlet 201 together with the second and third gas stream inlets 202 and 203, respectively.

The operating principles and the actions of the first pneumatic driving device for micro fluids are the same as those described in FIG. 1, that is, the gas streams enter the device at the second gas stream inlet 202 and at the third gas stream inlet 203, go through the second gas stream fender 208, and are applied as the sources for suction and exclusion forces. The operating principles and actions of the second pneumatic driving device for micro fluids are also similar to those discussed in FIG. 1. The only one difference is that the second gas stream inlet 202 and the third gas stream inlet 203 are utilized and treated together as the common gas stream inlet. That is, whether the gas streams enter the device at the second gas stream inlet 202 or at the third gas stream inlet 203 and go through the second gas stream fender 208, they will cause the suction force (the force from up to down) exerted on the micro fluids inside the second micro pipe 210. The gas stream that enters the device at the first gas stream inlet 201 causes the suction force for the micro fluids inside the second micro pipe 210 after it goes through the first gas stream fender 207.

Whether the force exerted on the micro fluids inside the third micro pipe 211 is a suction force or a exclusion force depends on the forces exerted on the micro fluids inside the first micro pipe 209 and the second micro pipe 210. That is, the motions of the micro fluids should be calculated by the Navier-Stokes equation of fluid mechanics.

Therefore, the confluence and anti-confluence of micro fluids can be accomplished through the proposed recursive pneumatic driving device for micro fluids by supplying two gas streams. That is, the micro fluids inside the third micro pipe 211 shown in FIG. 2 are controlled to flow into the first micro pipe 209 and the second micro pipe 210 separately, and the anti-confluence ratio of micro fluids into these two micro pipes can be controlled to achieve the value from 0% to 100%. Conversely, the micro fluids inside the first micro pipe 209 and the second micro pipe 210 can also be controlled to mix into the micro pipe 211.

Based on the above description the whole operating procedure of the proposed invention will be explained as follows: firstly the liquid examined species are injected into the device at the injection inlet 212 through the reagents and the third micro pipe 211 is filled with the liquid examined species. Secondly, the velocities and the flow directions of the liquid examined species inside the third micro pipe 211 can be controlled so that they are directed into the first micro pipe 209 and/or into the second micro pipe 210 simultaneously. This is done by controlling the flow velocities of the gas streams at the first gas stream inlet 201 the second gas stream inlet 202 and the third gas stream inlet 203. When the examined species are inside the first micro pipe 209 or the second micro pipe 210, their flow directions can be controlled by altering the flow velocities of the gas streams at the first gas stream inlet 201, the second gas stream inlet 202 and the third gas stream inlet 203 such that the required fluid power for the operations of the biochips can be passively supplied.

The forms of the gas stream fender 15, the first gas stream fender 207 and the second gas stream fender 208 shown in FIGS. 1 and 2 are shaped as a "solitary inland" and can be established by arbitrary combinations of triangles, squares, circles and polygons.

The connection between the fluid pipe and the gas stream flow path shown in FIG. 1 is shaped as an outfall 18 and is utilized to connect the fluid pipe and the gas stream flow path. Similarly, the outfalls 213 and 214 are established in the connection between the fluid pipe and the gas stream flow path shown in FIG. 2. The shapes of the outfalls can be a triangle, a connective gas stream flow path having a big open mouth or a connective fluid pipe having a small open mouth. The gas stream fenders can be set in the upper region of the outfall or near the outfall.

In addition, in order to find out the values of the suction and exclusion forces exerted on each of the micro pipes, the simulation program CFD–ACE+ can be applied and utilized to find out the adequate gas stream flow rates, and then based on the simulated flow rates the actual flow rates are adjusted to meet the requirements.

Figure 3:
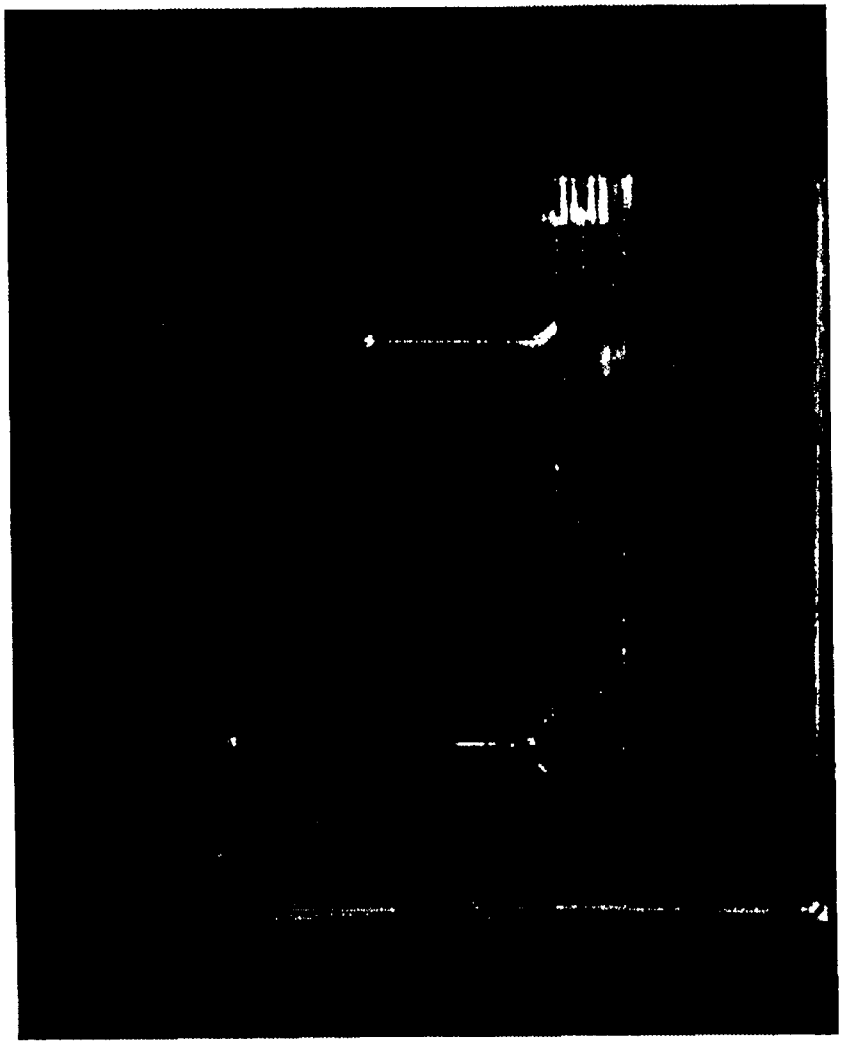
FIG. 3 illustrates the embodiment of the recursive pneumatic driving device for micro fluids of the invention.

FIG. 3 shows the first embodiment based on the design of FIG. 2, wherein the blank regions are the fillisters. The material used is a PMMA block with the scale of 100*100*50 mm. The widths of the three gas streams inlets are 3 mm, 1 mm and 1 mm, respectively, and the scale of the other structures are defined as the scale shown in the figure. The digging depths of all the structures are 1 mm, and the second PMMA block is bored in order to connect it to the micro pipes of the first block; the bored hole is the injection inlet for the micro liquids. The two PMMA blocks are connected to each other and the gas stream inlets are dug and bored once more with a lager diameter in order to connect them with the gas stream pipes. After completing all the procedures described above the embodiment of the invention can be accomplished as shown in FIG. 3.

A pneumatic source or pump will be supplied and connected with three parallel flow meters. These three flow meters are connected with the three gas stream inlets of the two PMMA blocks, respectively, and hence the experimental setup can be established.

Figure 4A:
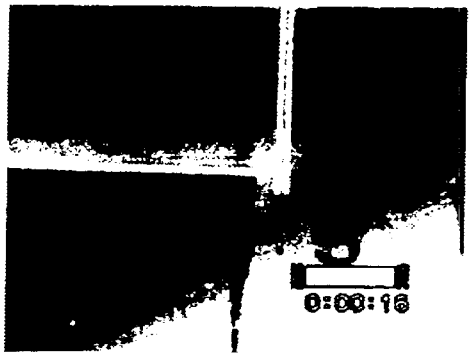
FIGS. 4A–4G illustrate the first operating experiments of the recursive pneumatic driving device for micro fluids of the invention.
Figure 4B:
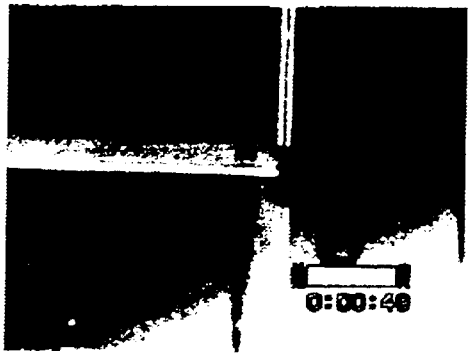
Figure 4C:
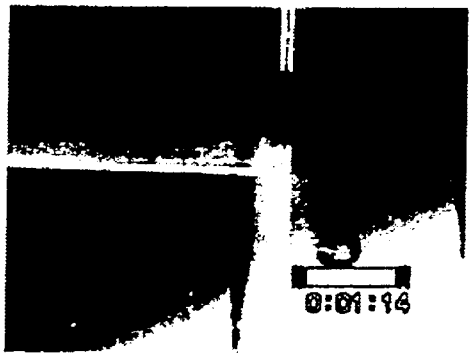
Figure 4D:
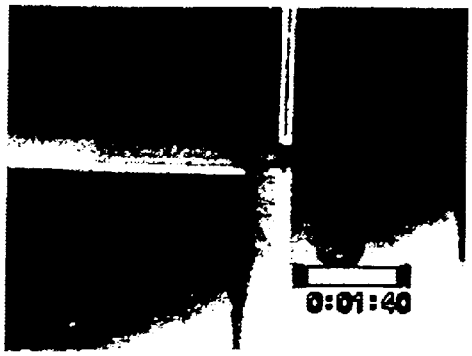
Figure 4E:
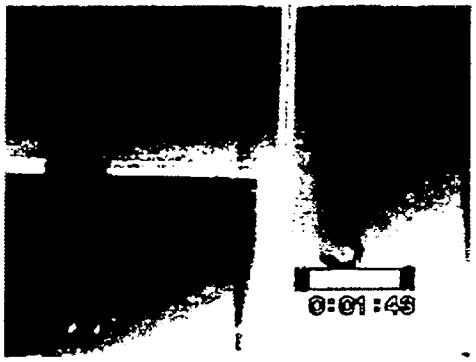
Figure 4F:
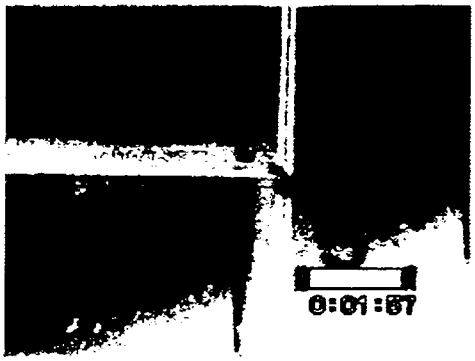
Figure 4G:
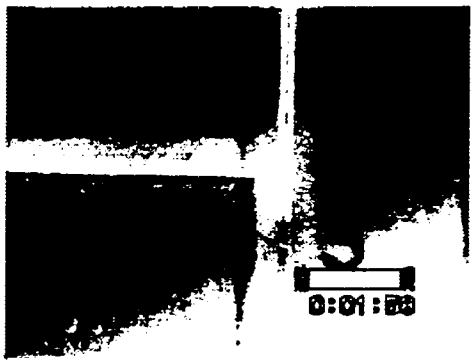

The detailed operating procedures of the invention will be described as follows: firstly some color ink (for example the blue ink) is dropped into the device so that it is easier to observe and photo the experimental results. Secondly, as shown in FIGS. 4A to 5G, the color ink is carefully controlled to flow inside each of the micro pipes repeatedly. Based on the prior simulated results, the flow rates measured by the three flow meters must be carefully controlled. Every experimental condition must also be carefully controlled so that the color ink can flow inside the micro pipes if the micro pipes have no valves. As shown in FIGS. 4A to 4G, the color ink can flow from the third micro pipe to the second micro pipe (Q1=16 LPM, Q3=1.2 LPM, as shown in FIGS. 4A to 4C), continuously flows from the second micro pipe to the first micro pipe (Q2=4.1 LPM, as shown in FIGS. 4C to 4E), and finally flows from the third micro pipe to the pipe 3 (Q2=3.2 LPM, Q3=1.4 LPM, as shown in FIGS. 4E to 4G). Therefore a whole loop motion is established.

Figure 5A:
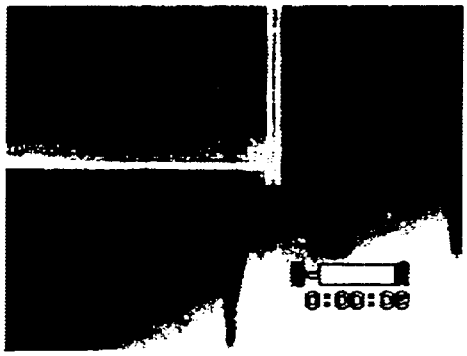
FIGS. 5A–5G illustrate the second operating experiments of the recursive pneumatic driving device for micro fluids of the invention.
Figure 5B:
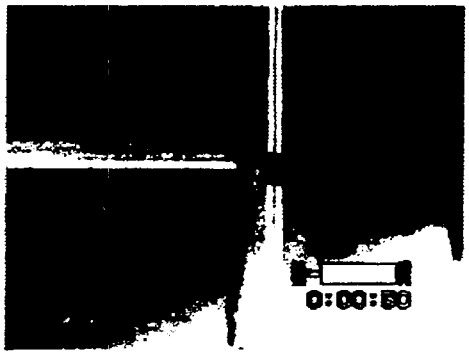
Figure 5C:
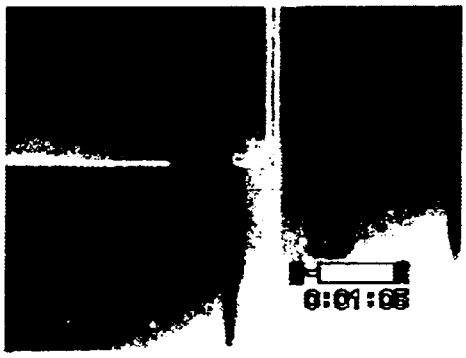
Figure 5D:
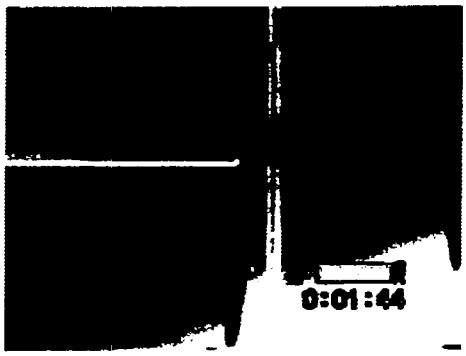
Figure 5E:
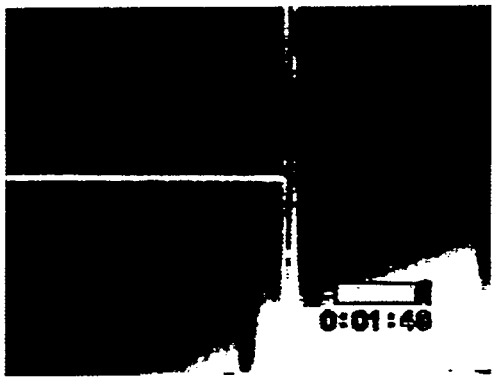
Figure 5F:
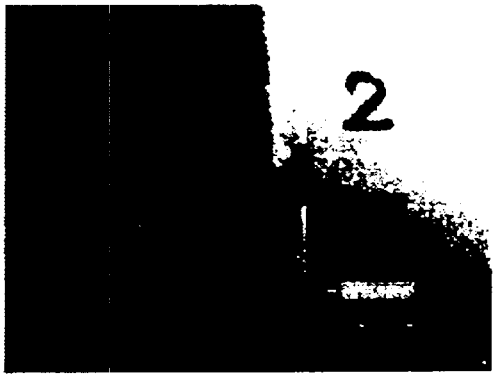
Figure 5G:
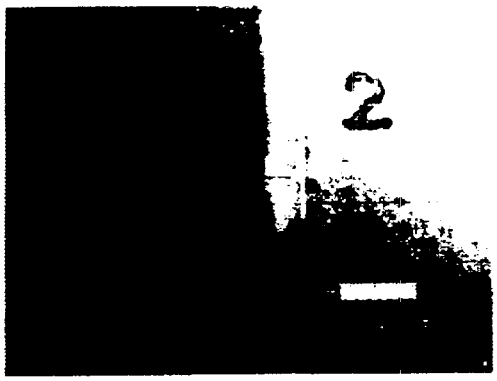

Refer to FIGS. 5A to 5G for the second flow situation. Firstly the color ink flows from the third micro pipe to the first micro pipe (Q1=19 LPM, Q2=4.2 LPM, Q3=0.5 LPM, as shown in FIGS. 5A to 5C), continuously flows from the first micro pipe to the second micro pipe (Q1=16 LPM, Q2=0.7 LPM, Q3=1.4 LPM, as shown in FIGS. 5C to 5E), and finally flows from the second micro pipe to the third micro pipe (Q2=4.9 LPM, Q3=1.1 LPM, as shown in FIGS. 5E to 5G). Therefore another whole loop motion is established.

Figure 6A:
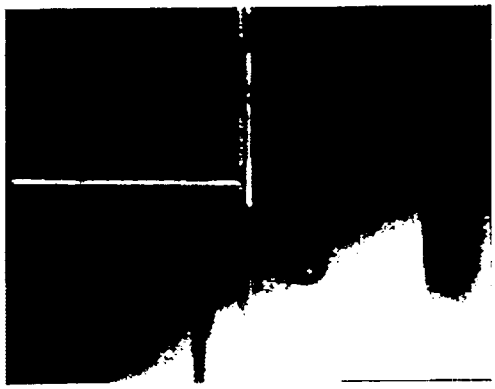
FIGS. 6A–6C illustrate the third operating experiments of the recursive pneumatic driving device for micro fluids of the invention.
Figure 6B:
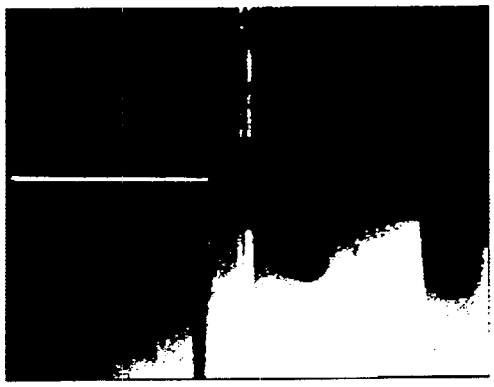
Figure 6C:
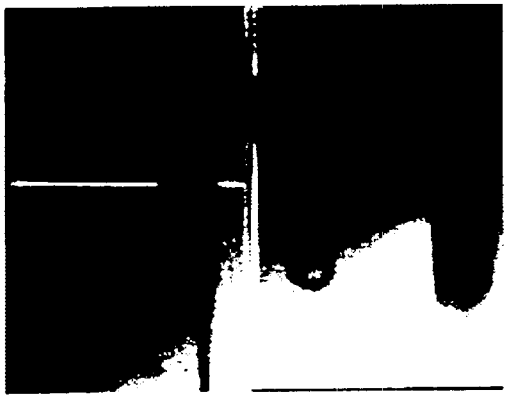

Refer to FIGS. 6A to 6C for the procedures to control the micro fluids to flow into different micro pipes. FIGS. 6A to 6C show that the color ink flows separately into two parts when it flows through the branch of the third micro pipe. These two separate parts of color ink flow independently into the first and second micro pipes. The separations of the micro fluids inside the first micro pipe or inside the second micro pipe can also be accomplished by controlling the velocities of the gas streams at the gas stream inlets.

The pneumatic driving device and the associated method for micro fluids proposed by the invention is clearly different from the pneumatic micro pump having no junctions proposed by Dr. Yuo. The characteristics of the pneumatic micro pump having no junctions proposed by Dr. Yuo are that the gas stream fender is connected with the main body of the micro pump and is set after the outfall. But from the invention the gas stream fender is formed as a "solitary inland". That is, it is isolated from the main body of the device and is set in front of the outfall. The triangle gas stream fender can be utilized to make the micro fluids flow repeatedly inside the micro pipes, and the concept of recursion (the superposition) is applied to guide the micro fluid inside the three or more micro pipes to mix or to separate.

The pneumatic driving device and the associated method for micro fluid proposed by the invention is also clearly distinct from the pressure difference driven pneumatic micro switch for micro fluids invented by Brody. In comparison with that proposed Brody it is clear that structure of the invention is quite simple as it is not necessary to control and adjust the three pneumatic supplies because only two pneumatic supplies need to be adjusted to meet the requirements. The parameters that need to be adjusted are only the flow velocities of the gas streams, and this point is significantly distinct from Brody's invention. Furthermore, there is a fixed outward blowing gas stream in the invention that will not pollute easily when this design is used for biochips.

The other advantages of the invention are the designs of the "solitary inland" triangle gas stream fender and the outfall, and there are no movable parts of the device. Only via the different suction and exclusion effects induced by the structure itself and by the regulations of the injection positions and the injection flow rates of the gas streams are the required motions of the micro fluids controlled.

By extending the triangle gas stream fender of the invention and the associated method for micro fluids together with the concept of recursion, the flow motions of the micro fluids can be completely controlled even if the micro pipes have two or more branches.

All the gas streams designed by the invention are designed to blow outward and thus the examined species or the reactive reagents inside the micro reactive module do not pollute the servo systems.

The working principles of the invention have no relation with the polarities or the ion concentrations of the driven micro fluids and consequently the applicability of the invention is rather extensive.

To summarize, the invention provides a microstructure having a simple structure, easy manufacturing processes and low production cost. It can be directly applied to control the flow motions of micro fluids by adjusting the injection positions and the injection flow rates of gas streams without any micro fluid valves.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pneumatic driving device for micro fluids comprising:

a gas stream inlet flow path structure constructed by two gas stream inlets, each inlet has a controllable flow rate, a solitary inland gas stream fender, a gas stream flow path, a gas stream outlet, wherein a pair of gas streams enter said device at said two gas stream inlets, flow through said gas stream fender and said gas stream flow path and flow out of said device is at said gas stream outlet, and a fluid pipe connected with said gas stream inlet flow path structure, wherein the device is adapted such that the suction, the exclusion, and the stagnation of one of the micro fluids inside the fluid pipe is induced by adjusting the flow rates of said pair of gas streams entered at said gas stream inlet flow path structure.

2. The pneumatic driving device of claim 1, wherein the connection part between said fluid pipe and said gas stream flow path structure is an outfall to connect said fluid channel to said gas stream flow path structure.

3. The pneumatic driving device of claim 2, wherein the shape of said outfall is selected from the group consisting of a inverted triangle, a connective gas stream flow path having an open mouth and a connective fluid pipe having an open mouth.

4. The pneumatic driving device of claim 1, wherein the shape of said gas stream fender is selected from the group consisting of a triangle, a square, a circle, a polygon and the arbitrary combination of the above shapes.

5. The pneumatic driving device of claim 1, wherein the connection part between said fluid pipe and said gas stream flow path structure is an outfall to connect said fluid channel to said gas stream flow path structure, said gas stream fender is settled in the position selected from the group consisting of said outfall and near said outfall.

6. The pneumatic driving device of claim 1, further comprising an injection inlet for injecting the micro fluids, which is settled in the end of said fluid pipe.

7. A recursive pneumatic driving device for micro fluids comprising:

a gas stream inlet flow path structure, which is a recursive structure constructed by at least three gas stream inlets, each inlet has a controllable flow rate, at least two solitary inland gas stream fenders, at least two gas stream flow paths, a gas stream flow outlet, wherein a group of gas streams enter said device at said at least three gas stream inlets, flow through said at least two gas stream fenders and flow out of said device is at said gas stream outlet, and a group of fluid pipes, having a first pipe, a second pipe and a third pipe, said first pipe and said second pipe and said gas stream flow path structure are connected together and said first, second and third pipes are connected by an intersection, wherein the device is adapted such that suction exclusion and stagnation of one of the micro fluids inside said group of fluid pipes is induced and said micro fluid is driven to mix, separate or turn the flow direction by adjusting the flow rates of said group of gas stream.

8. The recursive pneumatic driving device of claim 7, wherein the shapes of said gas stream fenders are selected from the group consisting of a triangle, a square, a circle, a polygon and the arbitrary combination of the above shapes.

9. The recursive pneumatic driving device of claim 7, wherein the connection parts between said group of fluid pipes and said gas stream flow path structure are at least two outfalls to connect said group of fluid pipes and said gas stream flow path structure.

10. The recursive pneumatic driving device of claim 9, wherein said gas stream fenders are settled in the positions selected from the group consisting of said outfalls or near said outfalls.

11. The recursive pneumatic driving device of claim 10, wherein the shapes of said outfalls are selected from the group consisting of an inverted triangle, a connective gas stream flow path having an open mouth and a connective fluid pipe having an open mouth.

12. The recursive pneumatic driving device of claim 7, further comprising a injection inlet for injecting the micro fluids, which is settled in the end of said third pipe.

13. The recursive pneumatic driving device of claim 7, wherein said pair of gas streams are composed of at least one portion of gas stream having specific flow direction and flow rate.

* * * * *